US005385766A

United States Patent [19]

Ferré

[11] Patent Number: 5,385,766

[45] Date of Patent: Jan. 31, 1995

[54] EXTRUDED PLASTICS NET BAG

[75] Inventor: Jacinto F. Ferré, Cardedeu, Spain

[73] Assignee: Intermas, S.A., Barcelona, Spain

[21] Appl. No.: 34,079

[22] Filed: Mar. 22, 1993

[30] Foreign Application Priority Data

Jan. 19, 1993 [ES] Spain ..... 9300101

[51] Int. Cl.[6] ..... B29D 22/00

[52] U.S. Cl. ..... 428/36.1; 383/20; 383/40; 383/106; 264/DIG. 81

[58] Field of Search ..... 428/36.1; 383/40, 20, 383/106; 264/DIG. 81

[56] References Cited

U.S. PATENT DOCUMENTS 4,795,268 1/1989 Jordá383 ..... 40/

*Primary Examiner*—George F. Lesmes
*Assistant Examiner*—Christopher W. Raimund
*Attorney, Agent, or Firm*—Bell, Seltzer, Park & Gibson

[57] ABSTRACT

An extruded plastics net bag is formed by a tubular mesh body having a band which, on one side panel of the bag, extends longitudinally from the bottom to the mouth of the bag; the band and the bag are connected together by a weld line which defines the bottom of the bag and by the weld portions connecting the handles to the bag; the band is provided with two longitudinal folds defining a central longitudinal portion and two folded longitudinal portions superimposed on the inner side of the central portion, so that the respective free longitudinal edges of the folded portions are substantially adjacent.

5 Claims, 3 Drawing Sheets

EXTRUDED PLASTICS NET BAG

FIELD OF THE INVENTION

The invention relates to an extruded plastics net bag, formed from a tubular body of netting which in the flattened state defines two superimposed side panels and comprising: a mouth; two handles of plastics material, each of which has the ends thereof attached to the tubular body by welded sections; a bottom end formed by a line of welding joining said side panels together; and a band extending longitudinally on one of said side panels, from said bottom end to said mouth and which is attached to the body of the bag (a) by said line of welding defining the bottom end of the bag and (b) by two of said welded sections.

DESCRIPTION OF THE PRIOR ART

Spanish utility models 262.498 and 262.499 and the corresponding French patent 2,519,525 and German patent application DOS 33 00 573.7 of the assignee hereof, disclose arrangements relating to net bags, in which the bag body is provided on each of the side panels thereof with strips which are reinforced by having a greater mesh density than in the rest of the bag body, there being nevertheless interstices between the strands of said strips so that said strips are permeable. There are described, furthermore, handles which are welded to the reinforced strips and also the formation of the bag bottom by welding.

The said arrangements have represented the provision of notable advantages, particularly by providing the said reinforced strips, as an improvement over reinforced strips formed by a compact impermeable tape. The net bags having the latter type of strips suffer from the drawback that the bag bottom may not be closed by welding. In fact, in the case of impermeable compact strips or tapes, if the welding is sufficiently powerful to bond the superimposed compact strips together, it may be too powerful for the rest of the bag, causing the net structure to break; on the contrary, if the weld is gentle so as not to damage the net, it may be insufficient to bond the reinforced strips together. Therefore, the bottom of these bags must usually be effected by sewing, stapling or the like, which requires the application of items foreign to the bag, such as threads or staples, making it difficult to manufacture the bag and hindering the possibilities of automated manufacture. Where the bag bottom is welded, such bottom is weak.

Particularly where the bag is for use with delicate fruit, the impermeable compact strips also provide the drawback that the fruit in contact with said Strips may deteriorate easily for lack of sufficient airing.

Furthermore, the regular fact that the compact tapes mean a thickening of the bag body, with the consequent sharp edges, represents the drawback of eroding the fruit contained.

Finally, it is noted that it is not possible to bond the handles to the bag body in the case of net bags not having a reinforced area, since it would not be possible to supply a sufficient mass of plastic for the weld to be effective.

These known bags are highly appreciated for their qualities of strength, capacity and reliability and they are also produced in a rational manufacturing process which allows for a very high degree of automation, making for cheaper manufacture. The most usual application thereof is for packaging fresh vegetable produce, particularly oranges and lemons.

Nevertheless, it is known that there is an increasing requirement that the bags have labels or the like on which a wide variety of data may be provided, many relating to the contents, such as the origin and variety of the fruit, weight, size, date of picking or packaging, etc.

Furthermore, the fruit wholesalers and exporters are frequently required by the client to include in the label details concerning the client himself, such as a trademark, trading style or other details. It should also be noted that very frequently the wholesalers and exporters receive the customers purchase instructions with very short notice, whereby little time is available for labelling.

Spanish utility model 162.095 of the assignee discloses an extruded net bag comprising an inserted band of advertising material, containing devices, business references, art-work and the like, said band being laid on and attached to one of the bag side panels. This band is frequently useful, although it must be recognized that it is not very versatile.

In fact, the use of bags with printed advertising bands requires an enormous stock of bags to be held, formed by groups of bags, so that there is a group for each class of labels, with all the variety and complexity that this involves, apart from the burden of having such a stock of bags immobilized.

Furthermore, it is obvious that the end use of the bags is not compatible with an adequate conservation of conventional labels, since it is easy for them to suffer the consequences of leaking liquids and relatively violent friction.

Bearing these facts in mind, the applicant has disclosed in Spanish utility models 8701106 and 8701724 and the corresponding U.S. Pat. No. 4,795,268 a bag comprising a tubular band (which may be sheetlike and transparent, or be of net structure) extending lengthwise along one of the bag side panels. Said band is attached to the bag by the weld made to provide the bag bottom and the welds attaching the handles to the bag. Between the latter there is an opening or mouth of the tubular band, or in the form of a pouch adapted to contain labels or identifying members.

With a bag of this type, instead of it being necessary to hold an enormous stock of bags, it is sufficient to hold an equivalent stock of labels (obviously much cheaper), or to have the possibility of printing the appropriate label on a common backing of paperboard, it being much easier to print on such supports than on a plastic and, therefore, the printing operation may be carried out in a very short time.

Nevertheless, these known bags have an important drawback as explained hereafter. The space between the two sections of welding forming the opening or mouth of the tubular band in pouch form is of necessity narrower than the width of the band and is also narrower than the width of the label which is to be inserted in the band. This means that it becomes rather difficult to insert the label in the band and this difficulty is greater the shorter the time available for preparing the bags with label.

SUMMARY OF THE INVENTION

In view of this situation, it is proposed to provide a bag which may be easily provided with a label (without it being previously incorporated in the bag) and which overcomes the drawbacks noted above.

All of this is achieved, according to the invention, with a bag of the type described at the beginning and in which said band is provided with two longitudinal folds which define a central longitudinal section and two folded longitudinal sections which are superimposed, at least in part, on said central section and are comprised between the central section and the tubular body, each of said folded longitudinal sections having a free longitudinal edge with the respective free edges of both folded sections being generally adjacent.

BRIEF DESCRIPTION OF THE DRAWING

Further advantages and features of the invention will be appreciated from the following description in which there is related a preferred embodiment of the invention without any limitative nature and with reference to the enclosed drawings, in which.

DETAILED DESCRIPTION OF THE INVENTION

Figure 1:
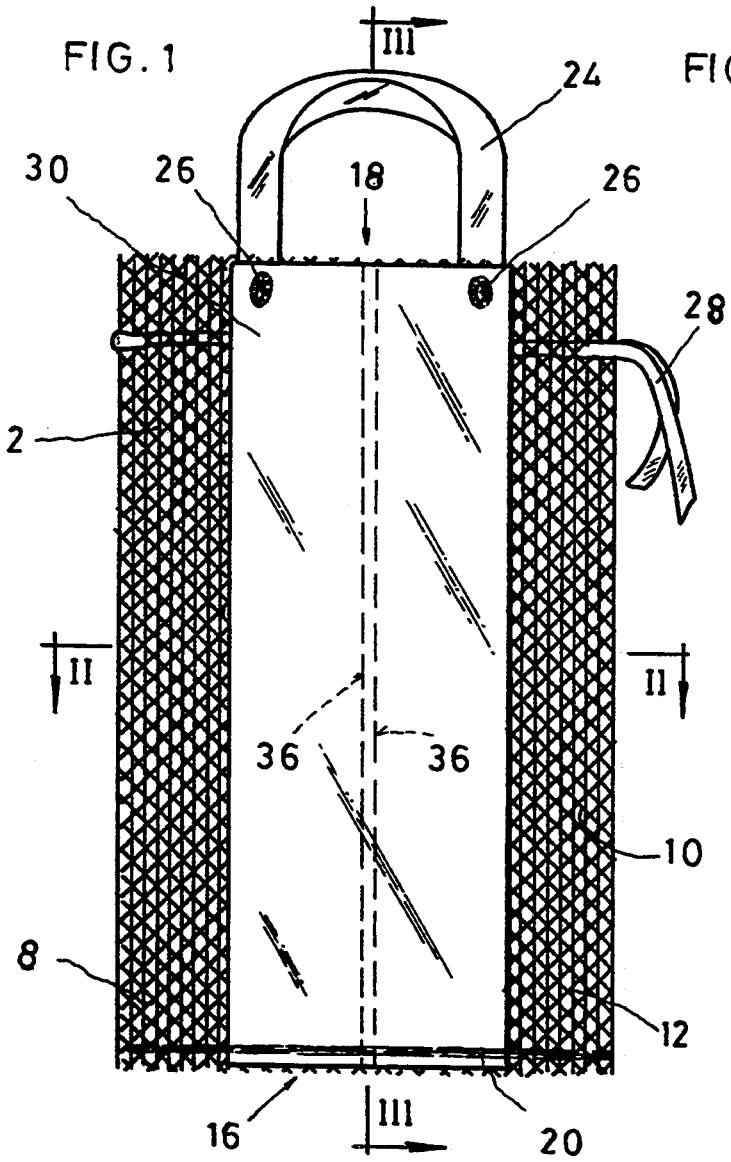
FIG. 1 is a front elevation view of a bag according to the invention, having a transparent sheet-like band devoid of a label in the interior thereof.
Figure 3:
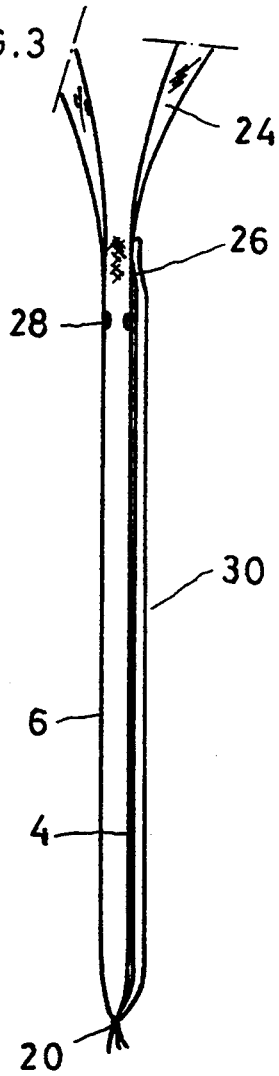
FIG. 3 is a schematic cross section view on the line III—III of FIG. 1, in which the comment made on FIG. 2 is pertinent.
Figure 2:
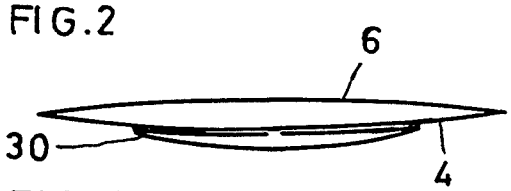
FIG. 2 is a schematic cross sectional view on the line II—II of FIG. 1, in which the separation between the various side panels and sheets forming the bag has been exaggerated.
Figure 4:
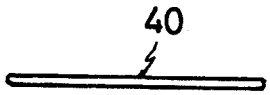
FIG. 4 is a cross section view of the label, the thickness thereof having been exaggerated.
Figure 5:
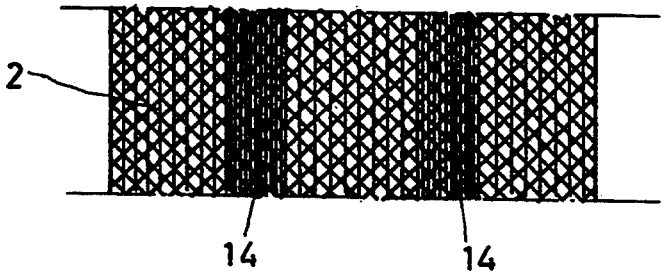
FIG. 5 is a view of a transverse section of either of the bag side panels.

The bag is formed by a body 2 of plastics net material formed by extrusion. Said body is tubular and in the flattened state defines two superimposable side panels 4, 6 and said net structure comprises strands 8, 10, 12 which may form two or more bundles of parallel strands. Thus, in the non-limitative embodiment shown in the Figures, there is a first bundle of parallel strands 8 disposed obliquely relative to the bag, a second bundle of strands 10 also disposed obliquely but having a different orientation from that of the first bundle and finally a third bundle of strands 12 disposed lengthwise of the bag.

Preferably each side panel 4,6 of the bag is provided with two strips 14 which extend from the bottom 16 to the mouth 18 of the bag, i.e. in the longitudinal direction thereof. Said strips are also preferably disposed symmetrically about the longitudinal centre line of the bag. The strands of said strips 14 forming the net have a greater mesh density than in the rest of the bag body. Nevertheless, between the strands of said strips 14 there are interstices (i.e. one strand is not juxtaposed to another) and therefore the strips 14 are permeable. In the preferred embodiment illustrated, the greater mesh density of the strips 14 is achieved by a larger number of strands disposed in the longitudinal direction of the bag. In the embodiments described and shown, the respective strips of each bag side panel are mutually mating, i.e. they are superimposed in the flat state of the bag.

The bag bottom is closed by one or more weld lines 20, which are obviously thicker in the sections of said line 20 corresponding to the strips 14, since the amount of plastic involved in the welding process is greater in those sections. The weld line 20 has been shown simplified by straight lines, although in reality it is formed by an irregular line which is affected by the orientations of the strand bundles. The bottom sections of the strips 14 provide the necessary strength to the bag bottom, whereby said bottom duly responds to the stress to which it is subjected, which would not happen if the whole weld line had the properties of the sections other than the reinforced sections.

In turn, the handles 24 are made from plastics material which may be mutually welded with the plastics material of the body 2 of the bag and the ends of the handles mate with regions of the strips 14 adjacent the mouth 18, being attached by welded sections 26. The welded connection is possible due to the greater density of the strip mesh, allowing a sufficient mass for the weld to be effective to be provided.

Further to the said members, it is also contemplated that the bag be provided with a cord, tape of the like 28 threaded through interstices of the bag close to the mouth 18 thereof, such that by pulling the ends of the cord or tape 28, the mouth 18 may be closed by throttling.

Figure 6:
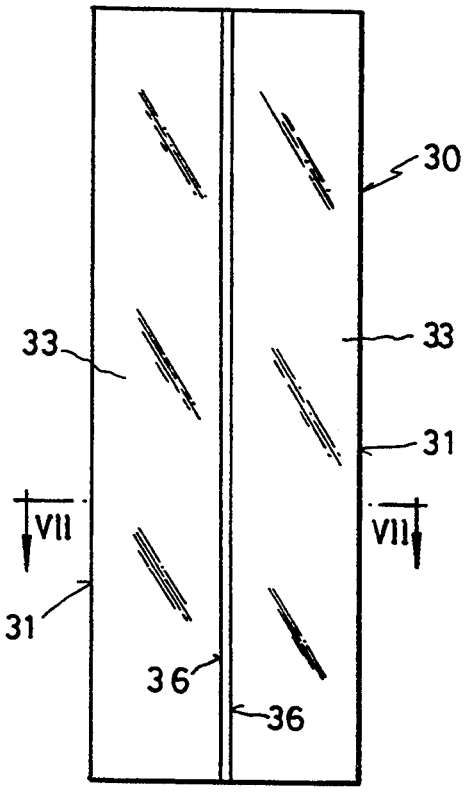
FIG. 6 is an elevation view of a trans:parent sheet-like band, at the portion where it is superimposed on the bag.
Figure 7:
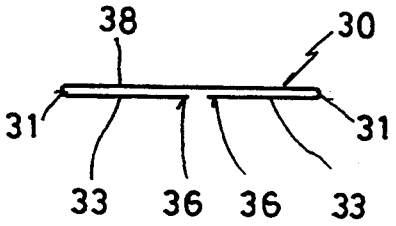
FIG. 7 is a cross section view on the line VII—VII of FIG. 6, in which the separation between the folds of the band and the front portion thereof has been exaggerated.
Figure 8:
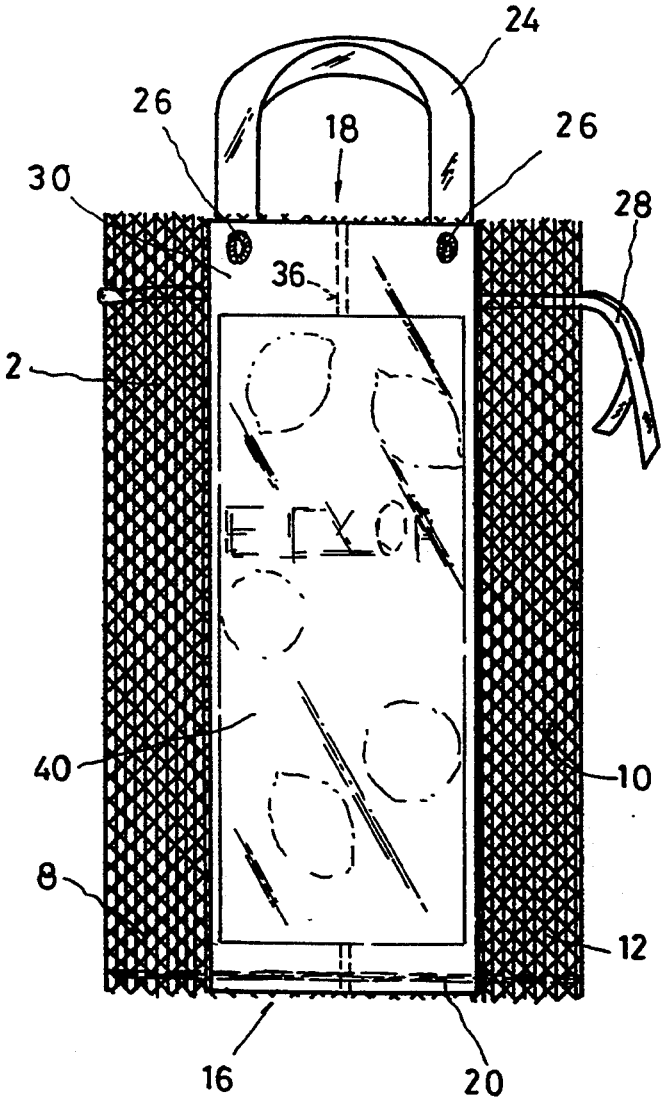
FIG. 8 is a similar view to FIG. 1, in which the band contains a label.
Figure 9:
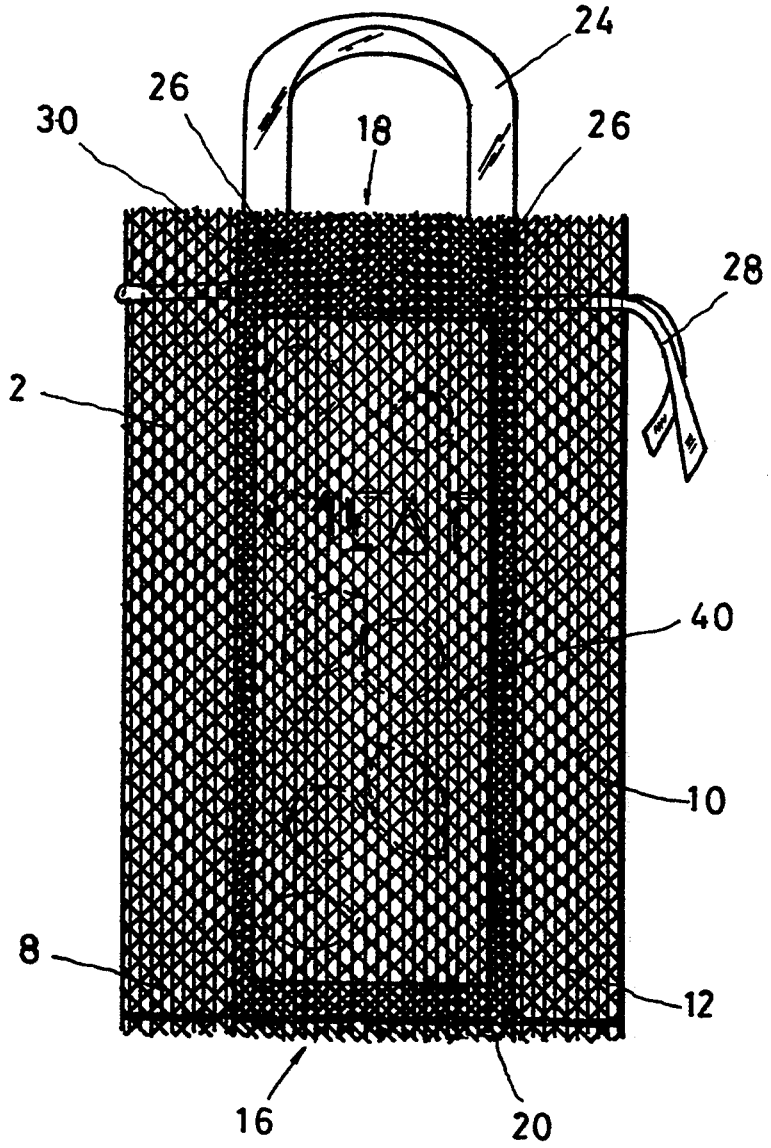
FIG. 9 is a similar view to the previous one, of a band formed by net material.

The bag described is provided, according to the invention, with a band 30 which may be sheet-like or net structure. This band (FIGS. 6 and 7) is provided with two longitudinal folds 31 defining two longitudinal sections 33, which have free longitudinal edges 36, such that both free longitudinal edges are situated generally adjacent to each other, either juxtaposed, or without the respective longitudinal sections 33 being superimposed (as shown in FIGS. 6 and 7) or with the longitudinal sections 33 slightly overlapping. The band 30 is welded to the bag body 2 in such a way that the folded longitudinal sections 33 are superimposed, at least in part, on the centre section 38 of the band 30 and comprised between the said central section 38 of the band 30 and the tubular body 2.

The band extends longitudinally on side panel 4, from the bottom 16 to the mouth 18. The band 30 is joined to the tubular body 2 of the bag by the previously mentioned welds, namely the weld line 20 defining the bottom 16 of the bag and two of the welded sections 26 joining one of the handles 24 of the bag body 2.

Figure 10:
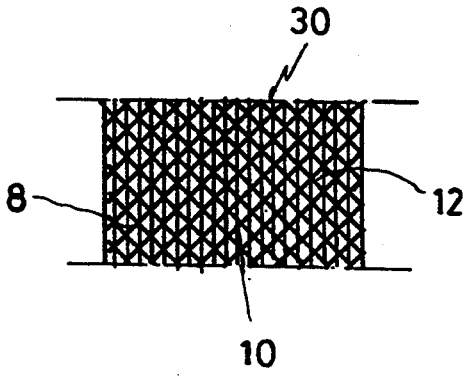
FIG. 10 is a view of a transverse section of the face of the band opposite the bag.

As stated above, the band 30 may be made from transparent sheet material (to allow the label to be seen) or it may be made from net material. In this case, it is preferable for it to be the same extruded plastics net material as forming the bag. Thus, there are to be seen thereon (FIG. 10) the strands 8, 10, 12 forming bundles of parallel strands. The band 30 does not require reinforced strips, since it is not subjected to large stress and also a reinforced strip would make it hard to see the label. Without the strands, the view of the label is quite satisfactory.

Said band is, therefore, suitable for containing labels or the like 40 which are visible since the strip, as said above, is either transparent or a net. The label is, furthermore, protected.

As will be understood, the relative position of the free edges 36 of the folded portions 33 allows easy access to the space formed by the centre portion 30 and the folded portions 33, whereby insertion of a label 40 in this space is very easily and quickly performed.

It should be seen that the incorporation of the band 30 in the bag is practically free from complications as far as the manufacture thereof is concerned. In fact, the die cutting operations forming the upper and lower edges of the bag body 2, at the same time form the edges of the band 30. On the other hand, the operation for forming the weld line 20 leads simultaneously to the production of the bag bottom and the sealing of the lower end of the band 30, joining it to the bag. Finally, the operation of forming the weld portions 24 to the body 2 provides at the same time a further means of joining the strip and the bag.

It is obvious, therefore, that the invention provides a bag adapted to receive in each case the appropriate label, that this label is protected by the band 30 allowing the label to be of a lower quality and it makes it unnecessary to maintain stock of bags diversified by their labels.

What I claim is:

1. An extruded plastics net bag, formed from a tubular body of netting which in the flattened state defines two superimposed side panels comprising:

a mouth; two handles of plastics material, each of which has the ends thereof attached to the tubular body by welded sections; a bottom end defined by a line of welding joining said side panels together; and a band extending longitudinally on one of said side panels, from said bottom end to said mouth and which is attached to the body of the bag (a) by said line of welding defining the bottom end of the bag and (b) by two of said welded sections joining the handles to the tubular body, wherein said band is provided with two longitudinal folds which define a central longitudinal section therebetween and two folded longitudinal sections which are superimposed, at least in part, on said central section of the band and are positioned between the central section of the band and the side panel of the tubular body to thereby define a longitudinal pouch, each of said folded longitudinal sections having a free longitudinal edge with the respective free edges of both folded sections being generally adjacent to allow access to the interior of the pouch.

2. The bag of claim 1, wherein said band is made from transparent sheet material.

3. The bag of claim 1, wherein said band is made from net material.

4. The bag of claim 3, wherein said band is made from the same extruded net material as the bag.

5. The bag of claim 1, wherein said tubular mesh body is provided with bands on each of the side panels which are reinforced by having a greater mesh density than the tubular body and wherein said sections welding the ends of the handles to the tubular body are located at said reinforced strips.

* * * * *

UNITED STATES PATENT AND TRADEMARK OFFICE

CERTIFICATE OF CORRECTION

PATENT NO. :5,385,766
DATED :January 31, 1995
INVENTOR(S) :Jacinto F. Ferre

It is certified that error appears in the above-indentified patent and that said Letters Patent is hereby corrected as shown below:

On the title page: Item [56]

References Cited - "383" should be moved to the next column to read -- 383/40 --.

Column 1, line 53, Strips" should be -- strips --.

Column 3, line 32, "trans:parent" should be -- transparent --.

Signed and Sealed this

Twenty-fifth Day of April, 1995

*Attest:*

*Attesting Officer*

BRUCE LEHMAN

*Commissioner of Patents and Trademarks*